US006591204B2

(12) United States Patent
Rossi et al.

(10) Patent No.: US 6,591,204 B2
(45) Date of Patent: Jul. 8, 2003

(54) METHOD AND DEVICE FOR ESTIMATING MAGNETIC FLUX IN AN ELECTROMAGNETIC ACTUATOR FOR CONTROLLING AN ENGINE VALVE

(75) Inventors: Carlo Rossi, Bologna (IT); Alberto Tonielli, Imola (IT)

(73) Assignee: Magneti Marelli S.p.A., Milan (IT)

( * ) Notice: Subject to any disclaimer, the term of this patent is extended or adjusted under 35 U.S.C. 154(b) by 1 day.

(21) Appl. No.: 09/848,553

(22) Filed: May 4, 2001

(65) Prior Publication Data

US 2002/0084777 A1 Jul. 4, 2002

(30) Foreign Application Priority Data

May 4, 2000 (IT) ..... BO2000A0248

(51) Int. Cl.[7] ..... G06F 19/00
(52) U.S. Cl. ..... 702/65; 361/152
(58) Field of Search ..... 702/65; 361/152; 324/223

(56) References Cited

U.S. PATENT DOCUMENTS 3,689,828 A * 9/1972 Kurose et al. ..... 324/223
6,249,418 B1 * 6/2001 Bergstrom ..... 361/152

* cited by examiner

*Primary Examiner*—John Barlow
*Assistant Examiner*—Xiuqin Sun
(74) *Attorney, Agent, or Firm*—Venable; Robert Kinberg; Chad C. Anderson

(57) ABSTRACT

A method and device for estimating magnetic flux in an electromagnetic actuator for controlling an engine valve, whereby the actuating body, made at least partly of ferromagnetic material, is moved towards at least one electromagnet by the force of magnetic attraction generated by the electromagnet; and the value of the magnetic flux through a magnetic circuit defined by the electromagnet and by the actuating body is estimated by measuring the values assumed by various electric quantities of an electric circuit connected to the magnetic circuit, calculating the time derivative of the magnetic flux as a linear combination of the values of the electric quantities, and integrating in time the derivative of the magnetic flux.

5 Claims, 3 Drawing Sheets

METHOD AND DEVICE FOR ESTIMATING MAGNETIC FLUX IN AN ELECTROMAGNETIC ACTUATOR FOR CONTROLLING AN ENGINE VALVE

The present invention relates to a method of estimating magnetic flux in an electromagnetic actuator for controlling an engine valve.

BACKGROUND OF THE INVENTION

As is known, tests are currently being conducted of internal combustion engines of the type described in Italian Patent Application BO99A000443 filed on Aug. 4, 1999, wherein the intake and exhaust valves are operated by electromagnetic actuators. Electromagnetic actuators definitely have various advantages, by enabling optimum control of each valve in any operating condition of the engine, unlike conventional mechanical actuators (typically, camshafts) which call for defining a valve lift profile representing no more than an acceptable compromise for all possible operating conditions of the engine.

An electromagnetic valve actuator for an internal combustion engine of the type described above normally comprises at least one electromagnet for moving an actuator body of ferromagnetic material and connected mechanically to the respective valve stem; and, to apply a particular law of motion to the valve, a control unit drives the electromagnet with time-variable current to move the actuator body accordingly.

However, for the electromagnet to be driven so as to move the actuator body according to the desired law of motion, various characteristic quantities of the system—in particular, the magnetic flux acting on the actuator body—must be estimated in substantially real time.

SUMMARY OF THE INVENTION

It is an object of the present invention to provide a method of estimating magnetic flux in an electromagnetic actuator for controlling an engine valve, and which is both cheap and easy to implement.

According to the present invention, there is provided a method of estimating magnetic flux in an electromagnetic actuator for controlling an engine valve, as claimed in claim 1.

The present invention also relates to a device for estimating magnetic flux in an electromagnetic actuator for controlling an engine valve.

According to the present invention, there is provided a device for estimating magnetic flux in an electromagnetic actuator for controlling an engine valve, as claimed in claim 6.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
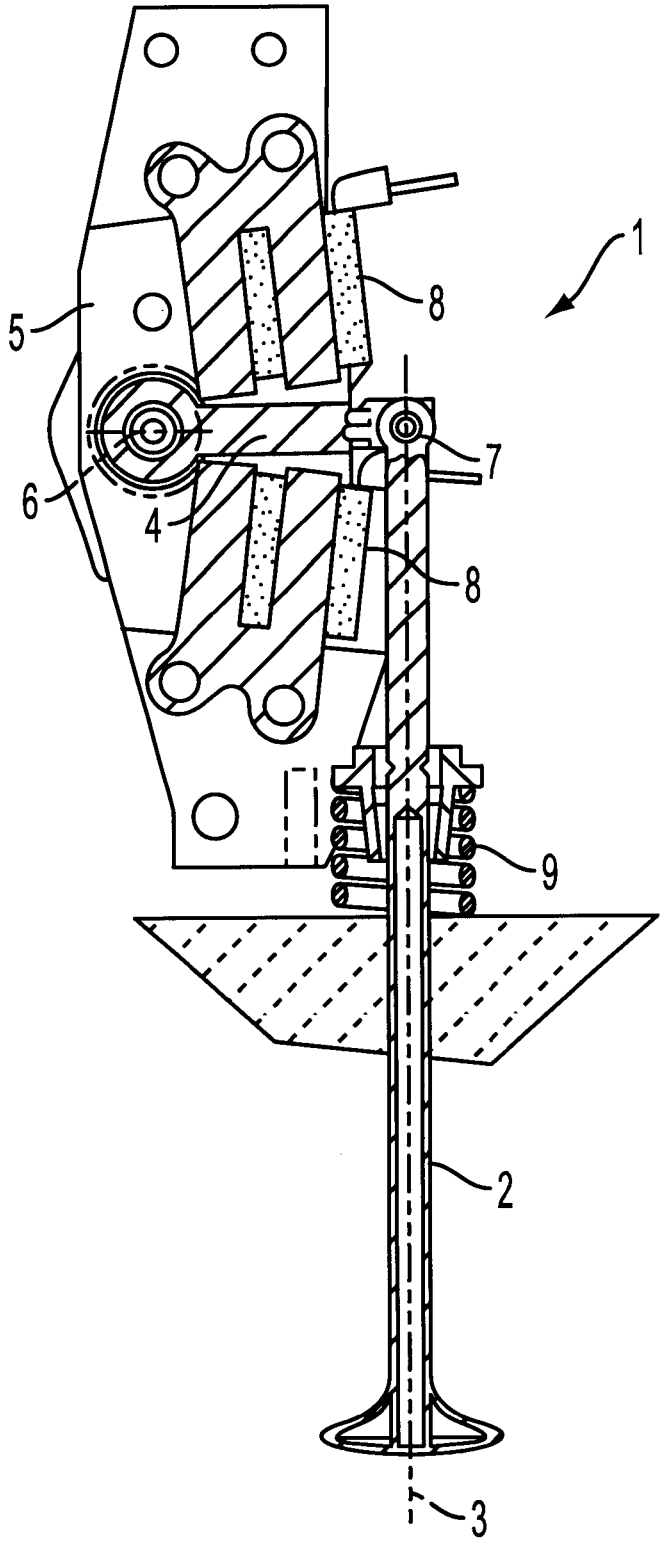
FIG. 1 shows a schematic, partly sectioned side view of an engine valve and a relative electromagnetic actuator operating according to the method of the present invention.

Number 1 in FIG. 1 indicates as a whole an electromagnetic actuator (of the type described in Italian Patent Application BO99A000443 filed on Aug. 4, 1999) connected to an intake or exhaust valve 2 of a known internal combustion engine to move valve 2, along a longitudinal axis 3 of the valve, between a known closed position (not shown) and a known fully-open position (not shown).

Electromagnetic actuator 1 comprises an oscillating arm 4 made at least partly of ferromagnetic material, and which has a first end hinged to a support 5 to oscillate about an axis 6 of rotation perpendicular to the longitudinal axis 3 of valve 2; and a second end connected by a hinge 7 to the top end of valve 2. Electromagnetic actuator 1 also comprises two electromagnets 8 fitted in fixed positions to support 5 and located on opposite sides of oscillating arm 4; and a spring 9 fitted to valve 2 and for keeping oscillating arm 4 in an intermediate position (shown in FIG. 1) in which oscillating arm 4 is equidistant from the pole pieces 10 of the two electromagnets 8.

In actual use, electromagnets 8 are controlled by a control unit 11 to alternately or simultaneously exert a magnetic force of attraction on oscillating arm 4 to rotate it about axis 6 of rotation and so move valve 2, along longitudinal axis 3, between said fully-open and closed positions (not shown). More specifically, valve 2 is set to the closed position (not shown) when oscillating arm 4 rests on the bottom electromagnet 8; is set to the fully-open position (not shown) when oscillating arm 4 rests on the top electromagnet 8; and is set to a partially open position when electromagnets 8 are both deenergized and oscillating arm 4 is maintained in said intermediate position (shown in FIG. 1) by spring 9.

Figure 2:
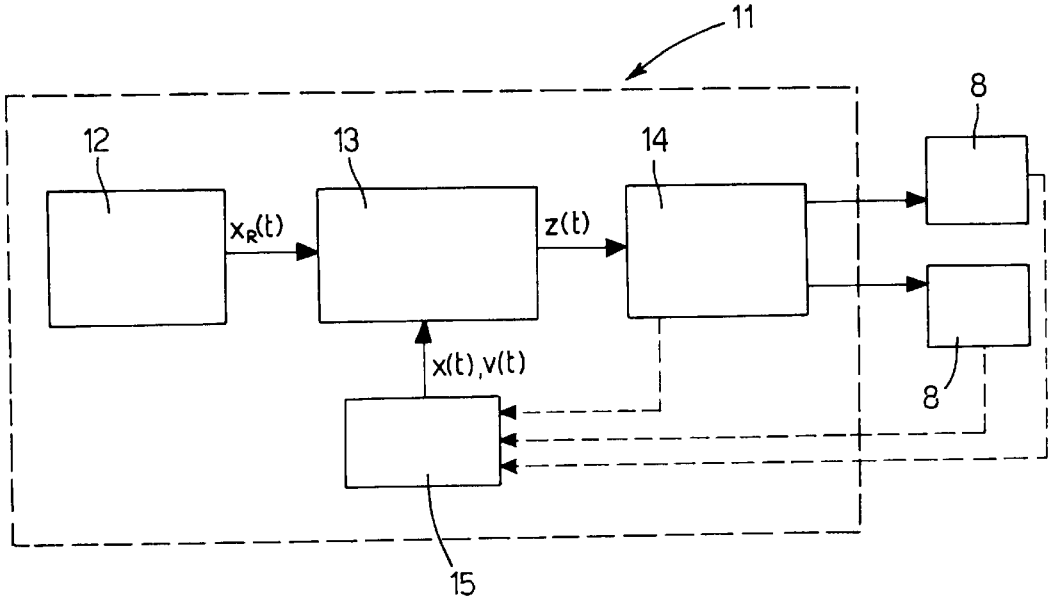
FIG. 2 shows a schematic view of a control unit for controlling the FIG. 1 actuator.

Control unit 11 feedback controls the position of oscillating arm 4, i.e. of valve 2, in substantially known manner on the basis of the operating conditions of the engine. More specifically, as shown in FIG. 2, control unit 11 comprises a reference generating block 12; a calculating block 13; a drive block 14 for supplying electromagnets 8 with time-variable current; and an estimating block 15 for estimating in substantially real time the position x(t) and speed v(t) of oscillating arm 4.

In actual use, reference generating block 12 receives a number of parameters indicating the operating conditions of the engine (e.g. load, speed, throttle position, drive shaft angular position, cooling liquid temperature), and supplies calculating block 13 with a target (i.e. desired) value $x_R(t)$ of the position of oscillating arm 4 (and hence of valve 2).

On the basis of the target value $x_R(t)$ of the position of oscillating arm 4 and the estimated value x(t) of the position of oscillating arm 4 received from estimating block 15, calculating block 13 processes and supplies drive block 14 with a control signal z(t) for driving electromagnets 8. In a preferred embodiment, calculating block 13 also processes control signal z(t) on the basis of an estimated value v(t) of the speed of oscillating arm 4 received from estimating block 15.

In an alternative embodiment not shown, reference generating block 12 supplies calculating block 13 with both a target value $x_R(t)$ of the position of oscillating arm 4, and a target value $v_R(t)$ of the speed of oscillating arm 4.

Figure 3:
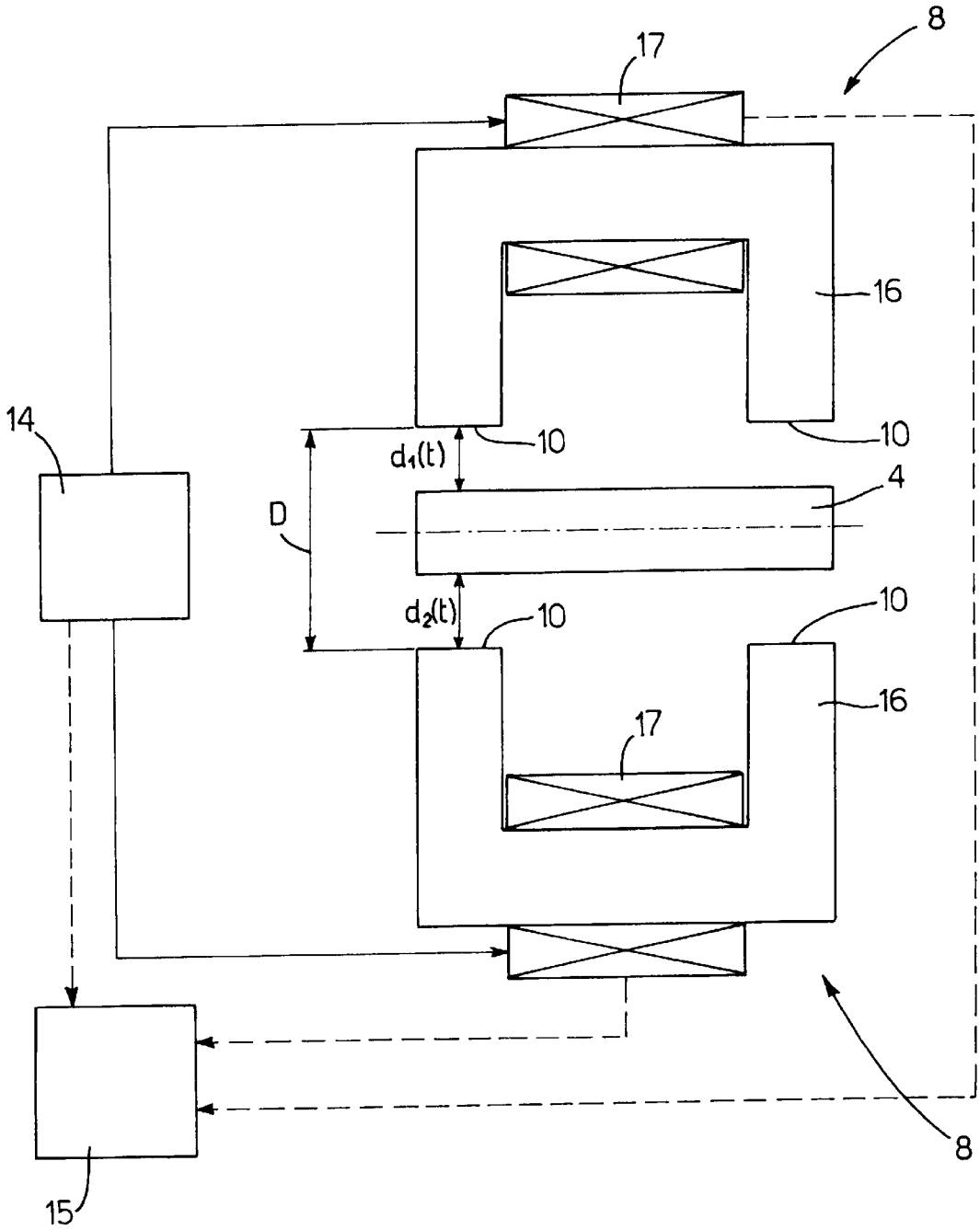
FIG. 3 shows, schematically, part of the FIG. 2 control unit.

As shown in FIG. 3, drive block 14 supplies both electromagnets 8, each of which comprises a respective magnetic core 16 fitted to a corresponding coil 17 to move oscillating arm 4 as commanded by calculating block 13.

Estimating block 15 reads values—explained in detail later on—from both drive block 14 and the two electromagnets 8 to calculate an estimated value x(t) of the position and an estimated value v(t) of the speed of oscillating arm 4.

Oscillating arm 4 is located between the pole pieces 10 of the two electromagnets 8, which are fitted to support 5 in fixed positions a fixed distance D apart, so that the estimated value x(t) of the position of oscillating arm 4 can be calculated directly, by means of a simple algebraic sum operation, from an estimated value d(t) of the distance between a given point of oscillating arm 4 and a corresponding point of either one of electromagnets 8. Similarly, the estimated value v(t) of the speed of oscillating arm 4 can be calculated directly from an estimated value of the speed between a given point of oscillating arm 4 and a corresponding point of either one of electromagnets 8.

To calculate value x(t), estimating block 15 calculates two estimated values $d_1(t)$, $d_2(t)$ of the distance between a given point of oscillating arm 4 and a corresponding point of each of the two electromagnets 8; and, from the two estimated values $d_1(t)$, $d_2(t)$, estimating block 15 calculates two values $x_1(t)$, $x_2(t)$, which normally differ from each other owing to measuring noise and errors. In a preferred embodiment, estimating block 15 calculates the mean of the two values $x_1(t)$, $x_2(t)$, possibly weighted according to the accuracy attributed to each value x(t). Similarly, to calculate value v(t), estimating block 15 calculates two estimated values of the speed between a given point of oscillating arm 4 and a corresponding point of each of the two electromagnets 8; and, from the two estimated speed values, estimating block 15 calculates two values $v_1(t)$, $v_2(t)$, which normally differ from each other owing to measuring noise and errors. In a preferred embodiment, estimating block 15 calculates the mean of the two values $v_1(t)$, $v_2(t)$, possibly weighted according to the accuracy attributed to each value v(t).

Figure 4:
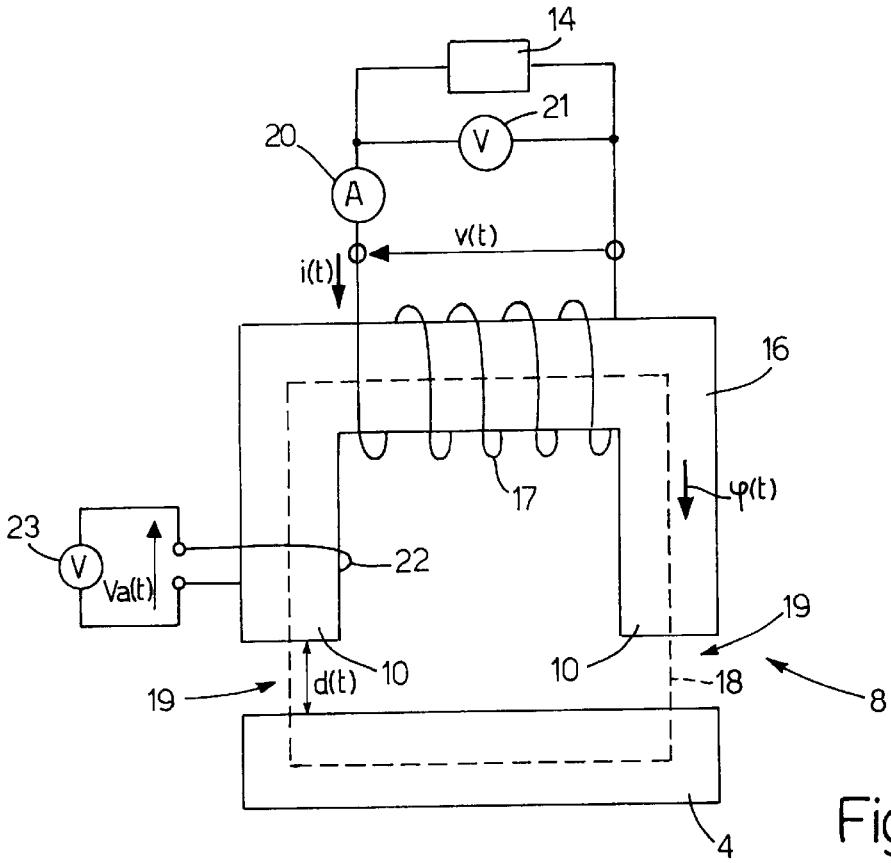
FIG. 4 shows a circuit diagram of a detail in FIG. 3.

The way in which estimating block 15 calculates an estimated value d(t) of the distance between a given point of oscillating arm 4 and a corresponding point of electromagnet 8, and an estimated value of the speed between a given point of oscillating arm 4 and a corresponding point of electromagnet 8, will now be described with particular reference to FIG. 4 showing one electromagnet 8.

In actual use, upon drive block 14 applying a time-variable voltage v(t) to the terminals of coil 17 of electromagnet 8, a current i(t) flows through coil 17 to generate a flux ϕ(t) through a magnetic circuit 18 connected to coil 17. More specifically, magnetic circuit 18 connected to coil 17 is defined by the core 16 of ferromagnetic material of electromagnet 8, by oscillating arm 4 of ferromagnetic material, and by the gap 19 between core 16 and oscillating arm 4.

The total reluctance R of magnetic circuit 18 is defined by the iron reluctance $R_{fe}$ plus the gap reluctance $R_o$; and the value of flux ϕ(t) circulating in magnetic circuit 18 is related to the value of current i(t) circulating in coil 17 by the following equation (where N is the number of turns in coil 17):

$$N*i(t)=R*\phi(t)$$

$$R=R_{fe}+R_o$$

The value of total reluctance R generally depends on both the position x(t) of oscillating arm 4 (i.e. the size of gap 19, which, minus a constant, equals the position x(t) of oscillating arm 4) and the value of flux ϕ(t). With the exception of negligible errors (i.e. roughly), the value of iron reluctance $R_{fe}$ can be said to depend solely on the value of flux ϕ(t), whereas the value of gap reluctance $R_o$ depends solely on position x(t), i.e.:

$$R(x(t),\ \phi(t))=R_{fe}(\phi(t))+R_o(x(t))$$

$$N*i(t)=R(x(t),\ \phi(t))*\phi(t)$$

$$N*i(t)=R_{fe}(\phi(t))+\phi(t)+R_o(x(t))*\phi(t)$$

By resolving the last equation shown above with respect to $R_o(x(t))$, the value of gap reluctance $R_o$ can be calculated, given the value of current i(t), which is easily measured using an ammeter 20; given the value of N (which is fixed and depends on the construction characteristics of coil 17); given the value of flux ϕ(t); and given the relationship between iron reluctance $R_{fe}$ and flux ϕ (known from the construction characteristics of magnetic circuit 18 and the magnetic characteristics of the material used, or easily determined by tests).

The relationship between gap reluctance $R_o$ and position x can be determined relatively simply by analyzing the characteristics of magnetic circuit 18 (an example model of the behaviour of gap 19 is shown in the equation below). Given the relationship between gap reluctance $R_o$ and position x, position x can be determined from gap reluctance $R_o$ by applying the inverse equation (using the exact equation or applying an approximate numeric calculation method) This can be summed up in the following equations (where $H_{fe}(\phi(t))=R_{fe}(®(t))*\phi(t))$:

$$R_o(x(t)) = \frac{N \cdot i(t) - H_{fe}(\varphi(t))}{\varphi(t)}$$

$$R_o(x(t)) = K_1[1 - e^{-k_2 \cdot x(t)} + k_3 \cdot x(t)] + K_0$$

$$x(t) = R_0^{-1}(R_o(x(t))) = R_0^{-1}\left(\frac{N \cdot i(t) - H_{fe}(\varphi(t))}{\varphi(t)}\right)$$

Constants $K_0$, $K_1$, $K_2$, $K_3$ can be determined experimentally by means of a series of measurements of magnetic circuit 18.

If flux ϕ(t) can be measured, position x(t) of oscillating arm 4 can therefore be calculated relatively easily. And, given the value of position x(t) of oscillating arm 4, the value of speed v(t) of oscillating arm 4 can be calculated by means of a straightforward time derivation operation of position x(t).

In a first embodiment, flux ϕ(t) can be calculated by measuring the current i(t) circulating through coil 17 using known ammeter 20, by measuring the voltage v(t) applied to the terminals of coil 17 using a known voltmeter 21, and given the value (easily measured) of resistance RES of coil 17. This method of measuring flux ϕ(t) is based on the following equations (where N is the number of turns of coil 17):

$$\frac{d\varphi(t)}{dt} = \frac{1}{N} \cdot (v(t) - RES \cdot i(t))$$

$$\varphi(T) = \frac{1}{N} \cdot \int_0^T (v(t) - RES \cdot i(t))dt + \varphi(0)$$

The conventional instant 0 is so selected as to accurately determine the value of the flux ϕ(0) at instant 0, and, in particular, is normally selected within a time interval in which no current flows in coil 17, so that flux ϕ is substantially zero (the effect of any residual magnetization is negligible), or is selected at a given position of oscillating arm 4 (typically, when oscillating arm 4 rests on pole pieces 10 of electromagnet 8) at which the value of position x and therefore of flux $\phi$ is known.

The above method of calculating flux $\phi(t)$ is fairly accurate and fast (i.e. with no delays), but poses several problems due to the voltage v(t) applied to the terminals of coil 17 normally being generated by a switching amplifier integrated in drive block 14 and therefore varying continually between three values ($+V_{supply}$, 0, $-V_{supply}$) two of which ($+V_{supply}$ and $-V_{supply}$) have a relatively high value which is therefore difficult to measure accurately without the aid of relatively complex, high-cost measuring circuits. Moreover, the above method of calculating flux $\phi(t)$ calls for continually reading the current i(t) circulating through coil 17, and for knowing at all times the value of resistance RES of coil 17, which, as known, varies alongside a variation in the temperature of coil 17.

In an alternative embodiment, magnetic core 16 is fitted with an auxiliary coil 22 (comprising at least one turn and normally Na number of turns), the terminals of which are connected to a further voltmeter 23. Since the terminals of coil 22 are substantially open (the internal resistance of voltmeter 23 is so high as to be considered infinite without this introducing any noticeable errors), no current flows in coil 22, and the voltage $v_a(t)$ at its terminals depends solely on the time derivative of flux $\phi(t)$, from which flux can be calculated by means of an integration operation (for value $\phi(0)$, see the above considerations):

$$\frac{d\varphi(t)}{dt} = \frac{1}{Na} \cdot v_a(t)$$

$$\varphi(T) = \frac{1}{Na} \cdot \int_0^T v_a(t)dt + \varphi(0)$$

Reading the voltage $v_a(t)$ of auxiliary coil 22 enables flux $\phi(t)$ to be calculated with no need for measuring and/or estimating electric current or resistance. Moreover, the value of voltage $v_a(t)$ is related (minus dispersions) to the value of voltage v(t) by the equation:

$$v_a(t) = \frac{Na}{N} \cdot (v(t) - RES \cdot i(t))$$

so that, by appropriately sizing the Na number of turns of auxiliary coil 22, the value of voltage $v_a(t)$ can be maintained fairly easily within an accurately measurable range.

Reading the voltage $v_a(t)$ of auxiliary coil 22, the value of flux $\phi(t)$ is therefore calculated more accurately, faster and more easily than by reading the voltage v(t) at the terminals of coil 17.

Of the two methods of estimating the time derivative of flux $\phi(t)$ described above, one embodiment only employs one, while an alternative embodiment employs both and uses the mean of the results of both methods (possibly weighted according to the accuracy attributed to each), or uses one result to check the other (a major difference between the two results probably indicates an estimating error).

In addition to estimating the position x(t) of oscillating arm 4, the flux $\phi(t)$ measurement can also be used by control unit 11 to determine the value of the force f(t) of attraction exerted by electromagnet 8 on oscillating arm 4 according to the equation:

$$f(t) = -\frac{1}{2} \cdot \frac{\partial R(x(t), \varphi(t))}{\partial x} \cdot \varphi^2(t)$$

$$f(t) = -\frac{1}{2} \cdot \frac{\partial R_0(x(t))}{\partial x} \cdot \varphi^2(t)$$

In an alternative embodiment not shown, control unit 11 feedback controls the value of flux $\phi(t)$, in which case, the flux $\phi(t)$ measurement is fundamental (feedback control of the value of flux $\phi(t)$ is normally applied as an alternative to feedback controlling the value of current i(t) circulating in coil 17).

It should be pointed out that the methods described above of estimating position x(t) only apply when current flows through coil 17 of an electromagnet 8. For this reason, estimating block 15 operates, as described above, with both electromagnets 8, so as to use the estimate relative to one electromagnet 8 when the other is deenergized. When both electromagnets 8 are active, estimating block 15 calculates the mean—possibly weighted according to the accuracy attributed to each value x(t)—of the two values x(t) calculated relative to both electromagnets 8 (position x estimated with respect to one electromagnet 8 is normally more accurate when oscillating arm 4 is relatively close to pole pieces 10 of electromagnet 8).

What is claimed is:

1. A method of estimating magnetic flux ($\phi$) in an electromagnetic actuator for controlling an engine valve, the electromagnetic actuator including an actuating body being made at least partly of ferromagnetic material, and being moved towards at least one electromagnet by magnetic attraction generated by the electromagnet, the method comprising:

measuring various electric quantities (i, v; $v_a$) of an electric circuit connected to a magnetic circuit, wherein the voltage ($v_a$) at terminals of an auxiliary coil connected to the magnetic circuit and linking the magnetic flux ($\phi$) is measured, the auxiliary coil being substantially electrically open;

calculating the time derivative of the magnetic flux ($\phi$) as a linear combination of the electric quantities.(i, v; $v_a$); and integrating in time the derivative of the magnetic flux ($\phi$), wherein the time derivative of the magnetic flux ($\phi$) and the magnetic flux ($\phi$) itself is calculated according to the following equations:

$$\frac{d\varphi(t)}{dt} = \frac{1}{Na} \cdot v_{aus}(t)$$

$$\varphi(T) = \frac{1}{Na} \cdot \int_0^T v_{aus}(t)dt + \varphi(0)$$

where:

$\phi$ is the magnetic flux ($\phi$)

Na is the number of turns of the auxiliary coil $v_a$. is the voltage ($v_a$) applied to the terminals of the auxiliary coil.

2. A method as claimed in claim 1, wherein the derivative of the magnetic flux ($\phi$) is integrated in time using an initial instant in time from which to commence the integration operation; said initial instant in time being selected within a time interval in which said actuating body is in a given known position.

3. A method as claimed in claim 1, wherein the derivative of the magnetic flux ($\phi$) is integrated in time using an initial instant in time from which to commence the integration operation; said initial instant in time being selected within a time interval in which said electromagnet is deenergized.

4. A device for estimating magnetic flux ($\phi$) in an electromagnetic actuator for controlling an engine valve, the electromagnetic actuator comprising:

an actuating body;

at least one electromagnet for moving the actuating body, made at least partly of ferromagnetic material, by magnetic attraction generated by the electromagnet, the electromagnet and the actuating body defining a magnetic circuit affected by said magnetic flux ($\phi$), and the electromagnet having an electric circuit connected to the magnetic circuit and linking at least part of said magnetic flux ($\phi$); and means for estimating having means for measuring electric quantities (i, v; $v_a$) of said electric circuit, said estimating means estimating the value of the magnetic flux ($\phi$) by calculating the time derivative of the magnetic flux ($\phi$) as a linear combination of the values of the electric quantities (i, v; $v_a$), and integrating in time the derivative of the magnetic flux ($\phi$), said estimating means comprising an auxiliary coil, which is connected to the magnetic circuit, links the magnetic flux ($\phi$), and is substantially electrically open; and said measuring means comprising a voltmeter for measuring the voltage ($v_a$) at the terminals of the auxiliary coil.

5. A device as claimed in claim 4, wherein said electromagnet comprises an electromagnet coil having terminals; and said measuring means comprise an ammeter for measuring current (i) circulating through the electromagnet coil, and a voltmeter for measuring the voltage (v) applied to the terminals of the electromagnet coil.

* * * * *